US006801166B2

(12) United States Patent
Mikkola et al.

(10) Patent No.: US 6,801,166 B2
(45) Date of Patent: Oct. 5, 2004

(54) PLANAR ANTENNA

(75) Inventors: Jyrki Mikkola, Kempele (FI); Petra Ollitervo, Oulu (FI); Petteri Annamaa, Oulunsalo (FI); Kimmo Antila, Kiviniemi (FI); Matti Niemi, Arkkukari (FI)

(73) Assignee: Filtronic LX Oy, Kempele (FI)

( * ) Notice: Subject to any disclaimer, the term of this patent is extended or adjusted under 35 U.S.C. 154(b) by 0 days.

(21) Appl. No.: 10/354,189

(22) Filed: Jan. 29, 2003

(65) Prior Publication Data

US 2003/0146878 A1 Aug. 7, 2003

(30) Foreign Application Priority Data

Feb. 1, 2002 (FI) ..... 20020200

(51) Int. Cl.[7] ..... H01Q 1/38
(52) U.S. Cl. ..... 343/700 MS; 343/830
(58) Field of Search ..... 343/700 MS, 746, 343/767, 830, 862

(56) References Cited

U.S. PATENT DOCUMENTS 4,613,868 A * 9/1986 Weiss ..... 343/700 MS
4,771,291 A * 9/1988 Lo et al. ..... 343/700 MS
5,313,216 A * 5/1994 Wang et al. ..... 343/700 MS
5,926,139 A 7/1999 Korisch

FOREIGN PATENT DOCUMENTS

SE 516 474 A1 5/2001

* cited by examiner

*Primary Examiner*—Shih-Chao Chen
(74) *Attorney, Agent, or Firm*—Darby & Darby

(57) ABSTRACT

Internal planar antenna especially applicable to mobile communication devices. A PIFA-type planar antenna is fed coaxially-like. This means that the feed conductor (321) of a radiating plane (310) is surrounded by a shield conductor (322) galvanically connected to the ground plane (GND) for the length between these planes. The shield conductor at the same time serves as a short circuit conductor for the antenna. The antenna is matched by means of a matching slot (317) going between the connection points of the feed and short circuit conductors, and/or of the shape of the short circuit conductor. A feed arrangement at issue increases antenna gain without increasing the SAR value of the antenna.

14 Claims, 5 Drawing Sheets

PLANAR ANTENNA

BACKGROUND OF INVENTION

The invention relates to an internal planar antenna especially applicable in mobile terminals. The invention further relates to a radio device employing an internal planar antenna.

In portable radio devices, mobile terminals in particular, the antenna is preferably placed within the casing of the device for increased comfort of use. There are certain basic electrical requirements for an antenna. Its impedance matching at the operating frequency has to be so good that, as regards matching, the efficiency of radio transmitting and receiving is at an acceptable level. The matching has to apply to the whole frequency band of the radio system, i.e. the antenna bandwidth has to correspond to the band in question. Resistive and dielectric losses in the antenna structure shall naturally be small. Smaller losses mean higher antenna gain and more efficient radiation. The radio device may be designed to function in a plurality of radio systems so that its antenna, too, must have more than one band. It is advantageous for the operation of a portable radio device if it has good antenna transmitting and receiving characteristics in all directions, although this is not necessary. On the other hand, it is considered undesirable that radiation is directed to the user's head, which imposes an extra requirement for the antenna of a radio device held on the user's ear.

An antenna with satisfactory characteristics which fits inside a small device is in practice most easily implemented as a planar structure: The antenna comprises a radiating plane and a ground plane parallel thereto. FIG. 1 shows an example of such a known planar antenna. It comprises a circuit board 101 with a conductive layer on the upper surface thereof, which conductive layer serves as a ground plane GND of the antenna. Elevated from the ground plane is a radiating plane 110 in connection with a feed conductor 121 and a short circuit conductor 122 which connects the radiating plane to the ground plane. The antenna is thus a planar inverted F antenna (PIFA). FIG. 1 also shows a portion of a dielectric frame 170 supporting the radiating plane. The radiating plane includes a slot 115 starting from the edge thereof and dividing the radiating plane into two branches of different lengths, as viewed from the short circuit point. Thus the PIFA has got two separate fundamental resonance frequencies and respective operating bands. In the example of FIG. 1 the feed conductor 121 and short circuit conductor 122 are of the spring contact type and constitute a single unitary piece with the radiating plane 110. Each conductor has a part parallel to the radiating plane, which functions as a spring, and a part extending therefrom towards the ground plane. At the lower end there is further a part parallel to the ground plane, comprising the contact proper. When the radiating plane is installed, a spring force presses the contacts against the upper surface of the circuit board 101, the contact of the short circuit conductor against the ground plane, and the contact of the feed conductor against a contact surface 105. This, in turn, is connected to an antenna port.

FIG. 2 shows another example of a known planar antenna. If differs from the example of FIG. 1 only as regards the feed and short circuit arrangements. The short circuit conductor is in this case a straight cylindrical conductor connected to the radiating plane 210 and ground plane GND by means of soldering, for example. It may also form a single piece with the radiating plane. The feed conductor 221, too, is a straight cylindrical conductor connected to the antenna port through a via 206 in the circuit board 201.

The antenna structures described above can be improved in terms of antenna gain e.g. by replacing copper in the planar surfaces with some other surface material having even better conductivity. A disadvantage, then, is that the specific absorption rate (SAR), i.e. energy converting into heat in the medium per unit mass and time, increases, too. Considering mobile phones, this means that more energy from the phone will be absorbed in the user's head.

SUMMARY

An object of the invention is to alleviate the above-mentioned disadvantage associated with the prior art. A planar antenna according to the invention is characterized in that which is specified in the independent claim 1. A radio device according to the invention is characterized in that which is specified in the independent claim 14. Advantageous embodiments of the invention are presented in the dependent claims.

The basic idea of the invention is as follows: a PIFA-type antenna is provided with a coaxial feed. This means that for the distance between the radiating plane and the ground plane the feed conductor of the radiating plane is surrounded by a shield conductor galvanically connected to the ground plane. The shield conductor at the same time functions as a short circuit conductor of the antenna. Antenna is matched by means of a matching slot between the connecting points of the feed and short circuit conductors and/or appropriate shaping of the short circuit conductor.

An advantage of the invention is that a feed arrangement according to it increases antenna gain without increasing the SAR value of the antenna. Thus, while the far field strength increases, the near field strength of the antenna, however, will not increase. If the trasmitting power of the antenna is decreased by an amount corresponding to the increase in gain, there is achieved a far field level equal to that of the prior art, but with a lower SAR value. Another advantage of the invention is that a structure according to it is relatively simple and inexpensive to fabricate.

BRIEF DESCRIPTION OF THE SEVERAL VIEWS OF THE DRAWING

The invention is below described in detail. Reference is made to the accompanying drawings in which.

DETAILED DESCRIPTION OF EMBODIMENTS OF THE INVENTION

Figure 1:
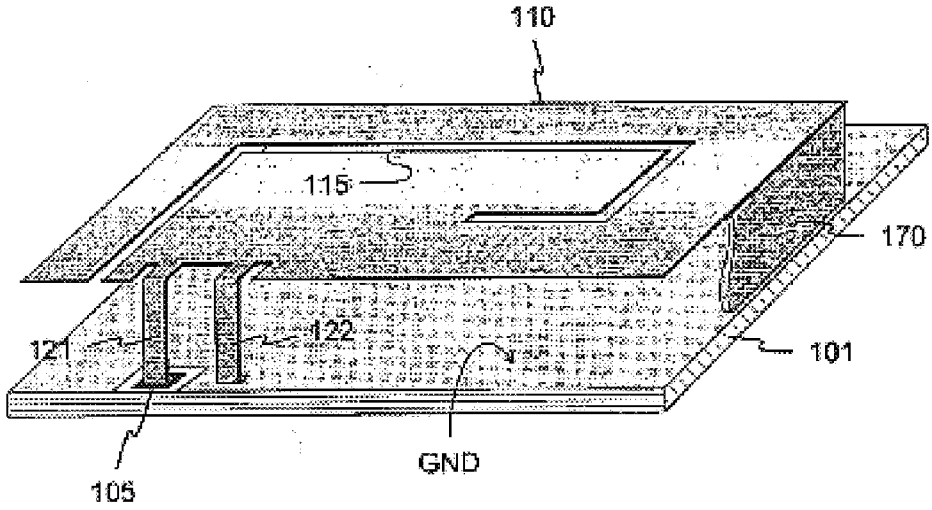
Fig. 1 PRIOR ART
FIG. 1 shows an example of a planar antenna according to the prior art.
Figure 2:
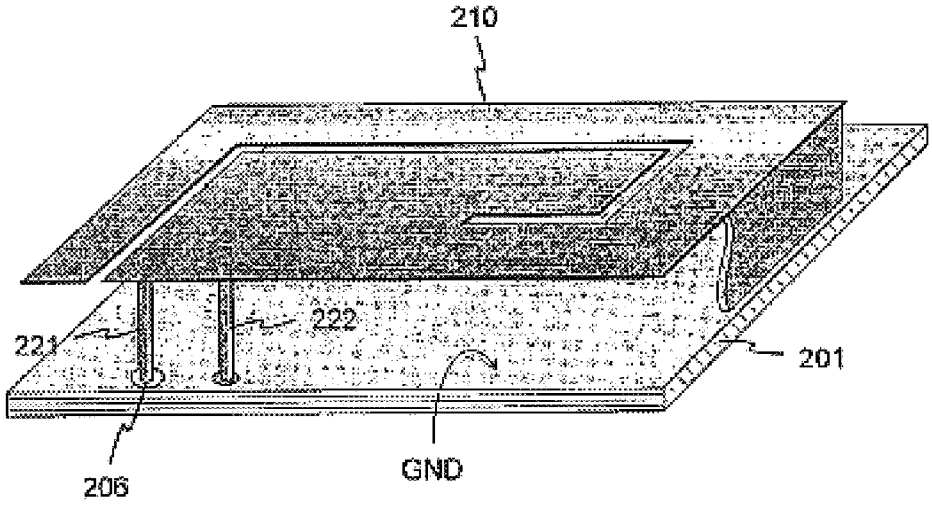
Fig. 2 PRIOR ART
FIG. 2 shows a second example of a planar antenna according to the prior art.

FIGS. 1 and 2 were already discussed in conjunction with the description of the prior art.

Figure 3:
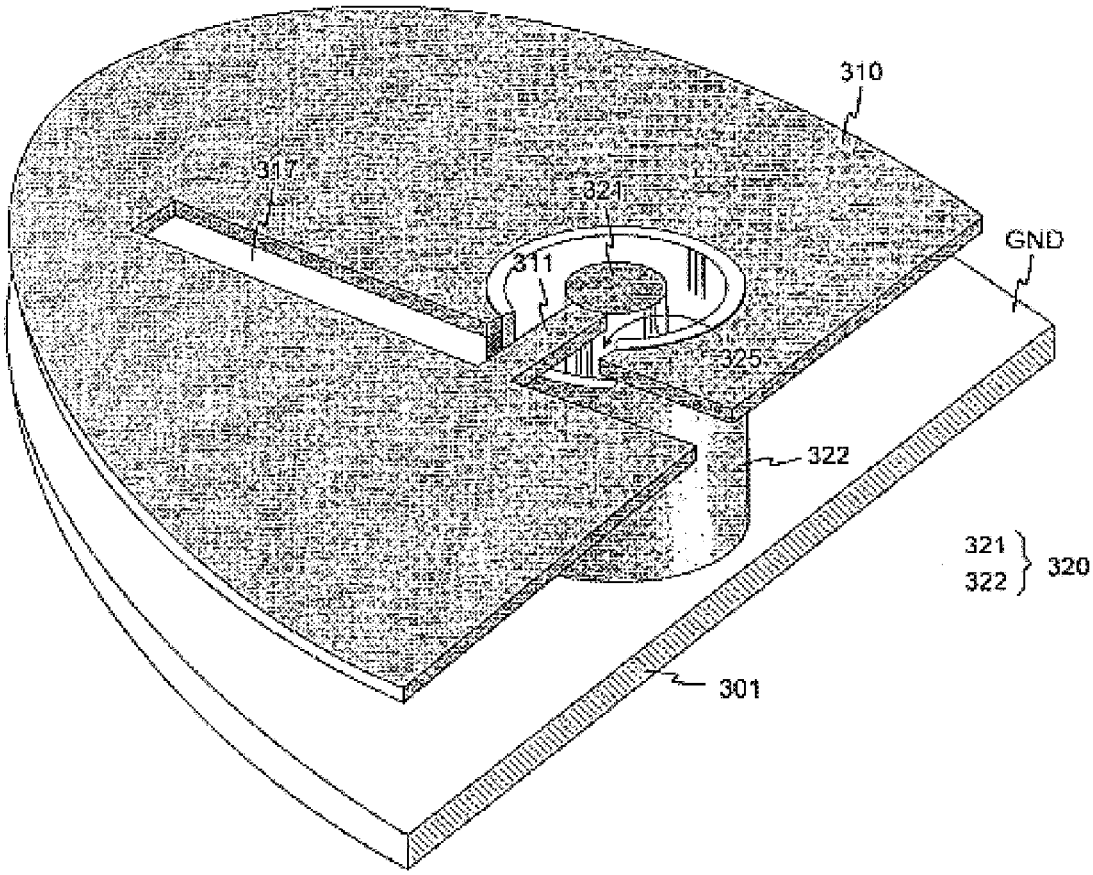
FIG. 3 illustrates the principle of a feed arrangement according to the invention.

FIG. 3 shows an exemplary structure illustrating the principle of a feed arrangement according to the invention. In FIG. 3 there can be seen portions of a radiating plane 310 of a planar antenna and of a board 301, with ground plane GND on the upper surface. Between these planes there is a cylindrical sheath conductor 322 the axis of which is perpendicular to said planes. The torus-shaped lower end surface of the sheath conductor rests against the ground plane. The upper end surface extends up to the height of the upper surface of the radiating plane 310. Accordingly, there is in the radiating plane a circular aperture the diameter of which equals that of the sheath conductor 322, whereby the radiating plane is pressed around the upper end of the cylindrical surface of the sheath conductor. The sheath conductor thus galvanically connects the ground plane to the radiating plane, serving as a short circuit conductor for the antenna. Inside the sheath conductor 322 there is a cylindrical feed conductor 321 of the antenna. The lower end thereof, not shown, extends beneath the board 301 through a via in the board, which via is isolated from the ground. The upper end of the feed conductor extends at least nearly to the height of the upper surface of the radiating plane 310. There is thus formed a coaxial feed line 320.

For antenna matching there has to be a certain distance between the feed point and short circuit point of the radiating plane. To that end, the radiating plane 310 has a matching slot 317 beginning from the edge thereof, and being tangent to the coaxial feed line. At the feed line the matching slot has an opening into said circular aperture in the radiating plane. At the upper end of the sheath conductor 322, at a point where the matching slot and the circular aperture in the radiating plane unite, there is a notch 325 such that there is free space as viewed perpendicularly from the upper end of the inner conductor 321 towards the matching slot. In this free space there is an intermediate conductor 311. One end of the intermediate conductor is galvanically connected to the upper end of the inner conductor and the other end to the radiating plane at the opposite edge of the matching slot, as viewed from the inner conductor. The galvanic connection between the feed point and short circuit point in the radiating plane is thus realized round the closed end of the matching slot 317, whereby the matching can be arranged by means of the length of the matching slot. Functionally, the intermediate conductor 311 is a latter portion of the feed conductor of the antenna. It may be a separate conductor attached by its both ends, or just a projection from the radiating plane.

Figure 4:
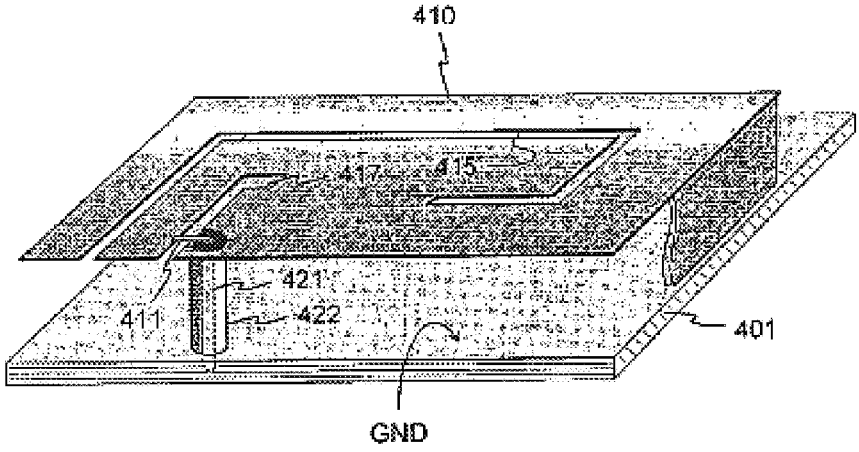
FIG. 4 shows an example of a planar antenna according to the invention.

FIG. 4 shows an example of a whole planar antenna according to the invention. In FIG. 4 there can be seen a circuit board 401, a conductive layer on the upper surface of which serves as a ground plane GND for the antenna. Above the ground plane there is a radiating plane 410, divided into two branches by a slot 415 like in FIGS. 1 and 2. The antenna feed arrangement, instead, is like the one depicted in FIG. 3. Between the radiating plane and ground plane there is a short circuit conductor 422 in the form of a cylindrical sheath the axis of which is perpendicular to said planes. Within the short circuit conductor there is a feed conductor 421 for the antenna, depicted in broken line in FIG. 4. At its lower end the feed conductor extends beneath the board 401 through a via in the board. As an extension to the sheathed feed conductor there is at its upper end a relatively short intermediate conductor 411. The intermediate conductor is connected to the radiating plane at that edge of the matching slot 417 which is opposite to the connecting point of the short circuit conductor.

Figure 5:
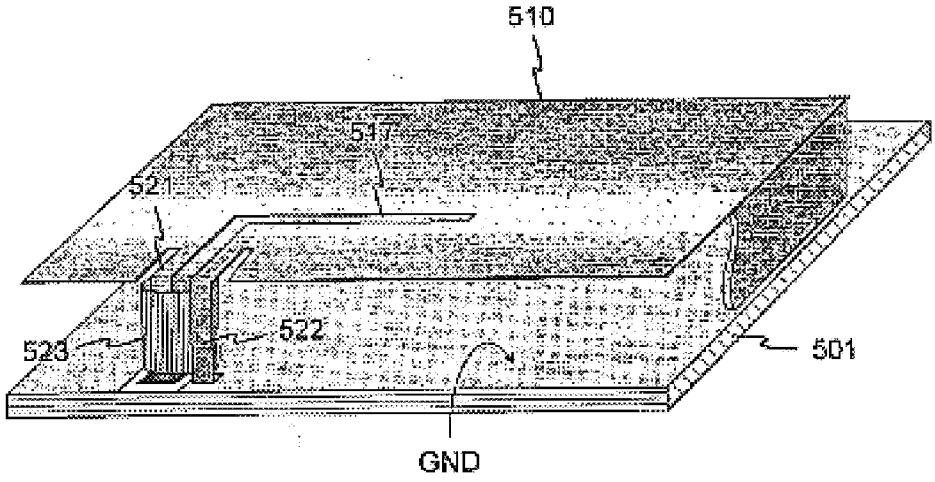
FIG. 5 shows a second example of a planar antenna according to the invention.

FIG. 5 shows a second example of a planar antenna according to the invention. In this example there is a circuit board 501, a conductive layer on the upper surface of which serves as a ground plane GND for the antenna. Above the ground plane there is a radiating plane 510. The feed conductor 521 and short circuit conductor 522 of the antenna are of the spring contact type, like in FIG. 1. The difference from the feed arrangement of FIG. 1 is that now the feed conductor 521 is surrounded by a sheath conductor 523 for nearly all of its vertical length. The sheath conductor is galvanically connected to the short circuit conductor 522. Initially the sheath conductor may be a planar extension to the short circuit conductor, which is then wrapped round the feed conductor as a closed sheath. Thus in all cases the sheath conductor 523 can be regarded as part of the short circuit conductor. The slot between the substantially horizontal spring portions of the feed conductor and short circuit conductor extends in FIG. 5 to the center region of the radiating plane. Thus there is provided the matching slot 517 required for antenna matching.

Figure 6:
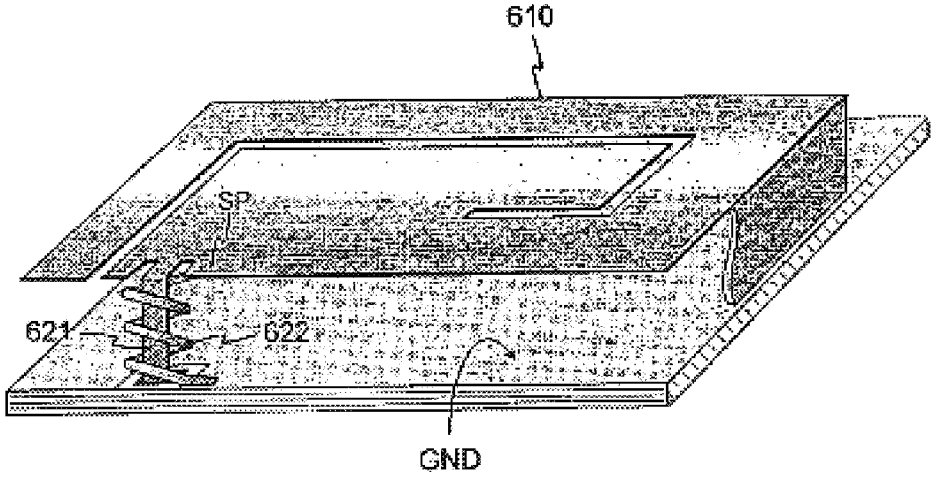
FIG. 6 shows a third example of a planar antenna according to the invention.

FIG. 6 shows a third example of a planar antenna according to the invention. In this case the basic structure of the antenna is similar to that depicted in FIGS. 1, 2, 4, and 5. Furthermore, the feed conductor 621 of the antenna is a spring contact conductor like those in FIGS. 1 and 5. The difference from the feed arrangement of FIG. 5 is that now the feed conductor 621 is surrounded, not by a sheath conductor but by a helix conductor 622. The lower end of the helix conductor is connected to the ground plane GND, and the upper end to the lower surface of the radiating plane 610 at a point SP. Additionally the feed arrangement differs from the example of FIG. 5 in that the radiating plane now has no matching slot proper. This is because with a helix-shaped short circuit conductor the matching of the antenna can be realized through appropriate dimensioning of the helix and by selecting an appropriate connection point SP in the radiating plane. There is then no need for a matching slot between the connection points of the short circuit conductor and feed conductor.

Figure 7:
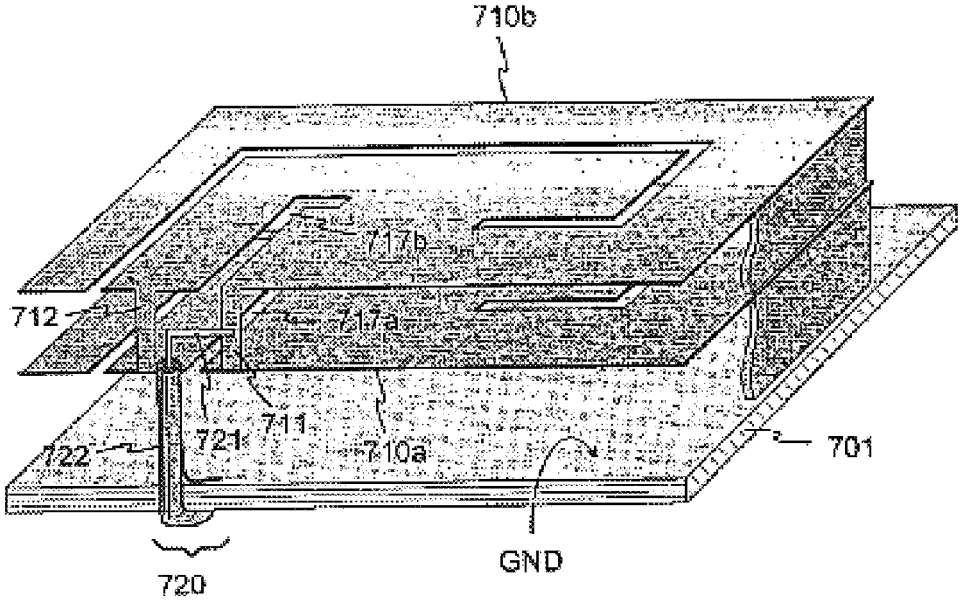
FIG. 7 shows a fourth example of a planar antenna according to the invention.

FIG. 7 shows a fourth example of a planar antenna according to the invention. In FIG. 7 there can be seen a circuit board 701, a conductive layer on the upper surface of which serves as a ground plane GND for the antenna. Above the ground plane there is a first radiating plane 710*a* and above that, a second radiating plane 710*b*. With two radiating planes the electrical characteristics of the antenna can be improved, above all the bandwidths can be increased. The radiating planes are interconnected at their edges by a first linking conductor 711 and second linking conductor 712. These are relatively close to each other. In the first radiating plane a first matching slot 717*a* starts from between said linking conductors, and in the second radiating plane a second matching slot 717*b* starts from between the linking conductors. A coaxial feed line 720 is brought to the radiating planes from an antenna port, not shown in FIG. 7. The sheath 722 of the feed line is galvanically connected to the ground plane and to the first radiating plane at that side of the matching slot 717*a* where the second linking conductor 712 is located. In FIG. 7 the inner conductor 721 of the feed line is galvanically connected to the first linking conductor 711. It may also be connected direct to either one of the radiating planes at that side of the matching slot where the first linking conductor is located. Thus the inner conductor goes within the sheath up to the first radiating plane.

Figure 8A:
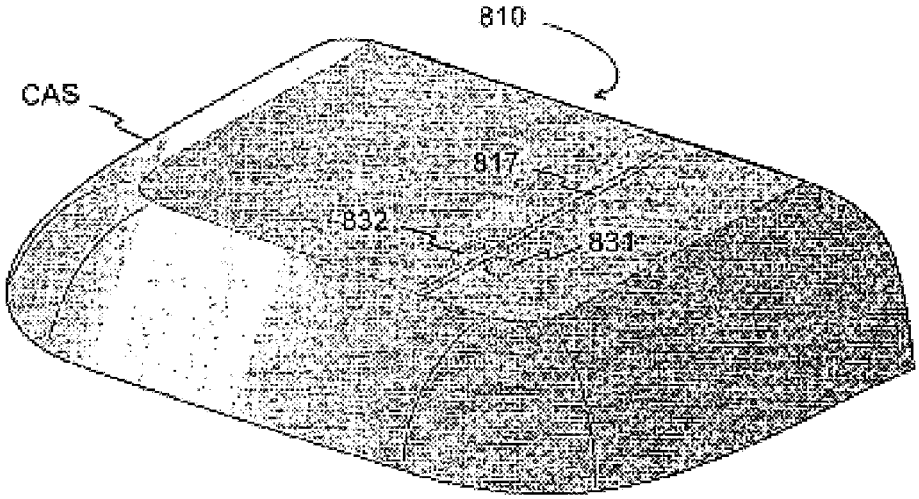
FIG. 8 shows a fifth example of a planar antenna according to the invention.
Figure 8B:
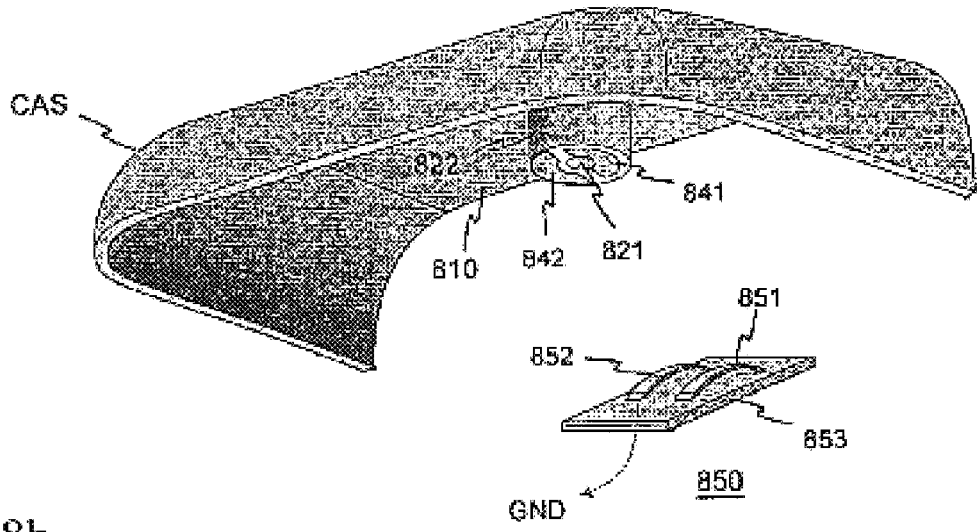

FIGS. 8*a,b* illustrate a fifth example of a planar antenna according to the invention. In this example the radiating plane and feed line of the antenna are integrated in the casing of the radio device in question. FIG. 8*a* shows the outside of the inventional portion CAS of the casing of the radio device. Let that portion be called a casing for short. The radiating plane 810 of the antenna is located on the inner surface of the casing. A broken line in FIG. 8*a* denotes a matching slot 817 in the radiating plane. On one side of the matching slot there is a connection point 831 for the inner conductor of the coaxial feed line, and on the other side there is a connection point 832 for the outer conductor, or sheath, of the feed line. FIG. 8*b* shows the inside of the casing CAS. The radiating plane 810 covers the planar portion of the inner surface of the casing and possibly also at least partly its curved edge portions. On the inner surface of the casing there is a cylindrical projection with an axial hole at the center thereof, the casing and projection constituting one solid piece of material. The outer surface of the cylinder is covered by a conductive material which forms the sheath 822 of the feed line. As was mentioned earlier, the sheath 822 extends up to the radiating plane only on one side of the matching slot. The axial hole of the cylinder is covered by a conductive material forming the inner conductor 821 of the feed line. The inner conductor extends to the radiating plane at the point 831 on the opposite side of the matching slot with respect to the connection point 832 for the outer conductor. On the bottom surface of the cylinder there is a first coupling strip 841 galvanically connected to the inner conductor 821, and a second coupling strip 842 galvanically connected to the outer conductor 822.

The radiating plane of the antenna can be placed in a corresponding way on the outer surface of the casing CAS instead of the inner surface thereof. In that case there are apertures in the casing for the inner and outer conductors of the feed line. All conductive parts of the casing CAS, i.e. the radiating plane, inner and outer conductors of the feed line, and the first and second coupling strips are realized by using MID (Molded Interconnect Device) technology, for instance.

FIG. 8*b* further shows an antenna interface component 850. The interface component includes a small dielectric planar body 853 and a first coupling spring 851 and second coupling spring 852 which are partly embedded in the planar body. The interface component is attached to a circuit board (not shown) having the ground plane for the antenna. The first coupling spring is connected to an antenna port on the circuit board, and the second coupling spring is connected to the ground plane GND. As the casing CAS is istalled, the feed line's first coupling strip 841 is pressed against the first coupling spring 851, and the second coupling strip 842 is pressed against the second coupling spring 852. The feed line sheath 822 is thereby connected to the signal ground and serves also as a short circuit conductor for the antenna, in addition to sheathing the inner conductor. The interface component 850 is advantageously a surface-mounted component. Instead of the shape depicted in FIG. 8*b* it may be coaxial, for instance.

Attributes "lower" and "upper" as well as "horizontal" and "vertical" refer in this description and in the claims to the antenna positions depicted in FIGS. 1 to 8, and are not associated with the operating position of the device.

The reactive near field of an antenna according to the invention is weaker than that of an otherwise identical antenna in which the feed conductor has no sheathing between the ground plane and radiating plane and in which the radiation power is the same. This results in less energy absorbed in the user's head in mobile phone applications. Decreases in measured SAR values are about 30% in the lower band of a dual-band antenna. This also means that the antenna gain can be increased by about a decibel without increasing the SAR value. The benefit is less marked in the upper band.

Figure 9:
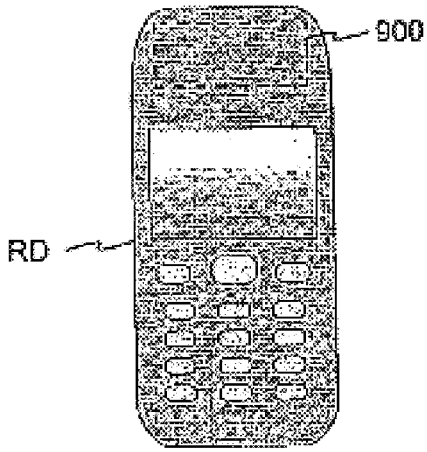
FIG. 9 shows an example of a radio device having an antenna according to the invention.

FIG. 9 shows a radio device RD including a planar antenna 900 according to the invention. The latter is completely located inside the casing of the radio device.

Above we described examples of a planar antenna according to the invention. The invention is not limited to those examples. For example, the short circuit conductor surrounding the feed conductor of the antenna may be an intermediate form between a cylindrical sheath and helix conductor. The radiating plane may be, instead of a conductive plate, a conductive layer on a surface of the antenna circuit board. Manufacturing method and materials of the antenna elements are in no way restricted. The inventional idea can be applied in different ways within the scope defined by the independent claim 1.

What is claimed is:

1. A planar antenna comprising within a radio device at least a first radiating plane and a ground plane, an antenna feed conductor connected to the radiating plane and a short circuit conductor between said planes, which feed conductor has a first point and a second point above a planar surface defined by the ground plane such that a vertical projection of the distance between the first and second points substantially is the same as the distance between the radiating plane and the ground plane, wherein the short circuit conductor surrounds the feed conductor for the whole length of a portion between the first and second points.

2. The planar antenna according to claim 1, the short circuit conductor forming a conductive sheath around said portion between the first and second points in the feed conductor.

3. The planar antenna according to claim 2, the feed conductor being a cylindrical conductor at least for the length of the portion between the first and second points and said conductive sheath being cylindrical sheath.

4. The planar antenna according to claim 1, wherein, to match the antenna, the radiating plane has a matching slot between connection points of the feed conductor and the short circuit conductor.

5. The planar antenna according to claim 2, further comprising a second radiating plane above the first radiating plane, wherein said conductive sheath extends up to the first radiating plane, as viewed from the ground plane, and the first and second radiating planes are galvanically interconnected at two points, to the first of which is also connected the feed conductor and to the second of which is also connected said conductive sheath.

6. The planar antenna according to claim 1, the radiating plane being a separate conductive plate.

7. The planar antenna according to claim 1, the radiating plane being a conductive layer on a surface of a circuit board.

8. The planar antenna according to claim 1, the radiating plane being a conductive layer on a surface of a part of a casing of the radio device.

9. The planar antenna according to claim 6, the feed conductor being a strip-like extension to the conductive plate of the radiating plane, extending to the ground plane.

10. The planar antenna according to 2 or 9, wherein also the short circuit conductor comprises a strip-like extension to the conductive plate of the radiating plane, extending to the ground plane, and said conductive sheath is an extension to this strip-like part.

11. The planar antenna according to claim 8, the conductive layers on the surfaces of said part of casing being formed using MID technology.

12. A radio device comprising an internal planar antenna, which has a radiating plane and a ground plane, an antenna feed conductor connected to the radiating plane and a short circuit conductor between said planes, which feed conductor has a first point and a second point between planar surfaces defined by the radiating plane and ground plane such that a vertical projection of the distance between the first point and the second point substantially is the same as the distance between the radiating plane and the ground plane, the short circuit conductor surrounding the feed conductor for the whole length of a portion between the first and second points.

13. A planar antenna comprising within a radio device a radiating plane and a ground plane, an antenna feed conductor connected to the radiating plane and a short circuit conductor between said planes, which feed conductor has a first point and a second point above a planar surface defined by the ground plane such that a vertical projection of the distance between the first and second points substantially is the same as the distance between the radiating plane and the ground plane, wherein the short circuit conductor surrounds the feed conductor for the whole length of a portion between the first and second points, the short circuit conductor forming a helix conductor around the feed conductor for the length of said portion between the first and second points.

14. A planar antenna comprising within a radio device a radiating plane and a ground plane, an antenna feed conductor connected to the radiating plane and a short circuit conductor between said planes, which feed conductor has a first point and a second point above a planar surface defined by the ground plane such that a vertical projection of the distance between the first and second points substantially is the same as the distance between the radiating plane and the ground plane, wherein the short circuit conductor surrounds the feed conductor for the whole length of a portion between the first and second points, the radiating plane being a conductive layer on a surface of a part of a casing of the radio device and the inner surface of said part of the casing being a projection with an axial hole in it, and said portion between the first and second points in the feed conductor being a conductive layer on the surface of said hole, and a portion in the short circuit conductor surrounding that portion in the feed conductor being a conductive layer on the outer surface of said projection.

* * * * *

UNITED STATES PATENT AND TRADEMARK OFFICE

CERTIFICATE OF CORRECTION

PATENT NO. : 6,801,166 B2
DATED : October 5, 2004
INVENTOR(S) : Jyrki Mikkola

It is certified that error appears in the above-identified patent and that said Letters Patent is hereby corrected as shown below:

Title page,
Item [73], Assignee, please delete "Filtronic LX Oy, Kempele (FI)" and substitute -- Filtronic LK Oy, Kempele (FI) --.

Signed and Sealed this

Eighth Day of March, 2005

JON W. DUDAS
*Director of the United States Patent and Trademark Office*